US005870117A

United States Patent [19]

Moore

[11] Patent Number: 5,870,117

[45] Date of Patent: Feb. 9, 1999

[54] LIQUID INK PRINTER INCLUDING A CAMMING PRINTHEAD TO ENABLE INCREASED RESOLUTION PRINTING

[75] Inventor: Steven R. Moore, Rochester, N.Y.

[73] Assignee: Xerox Corporation, Stamford, Conn.

[21] Appl. No.: 785,680

[22] Filed: Jan. 21, 1997

[51] Int. Cl.[6] ..... B41J 23/00; B41J 2/15

[52] U.S. Cl. ..... 347/37; 347/41

[58] Field of Search ..... 347/12, 15, 37, 347/40, 41; 346/29

[56] References Cited

U.S. PATENT DOCUMENTS

| | | | |
|---|---|---|---|
| 4,748,453 | 5/1988 | Lin et al. | 346/1.1 |
| 4,965,593 | 10/1990 | Hickman | 346/140 R |
| 4,967,203 | 10/1990 | Doan et al. | 346/1.1 |
| 4,999,646 | 3/1991 | Trask | 346/11 |
| 5,598,192 | 1/1997 | Burger et al. | 347/43 |

FOREIGN PATENT DOCUMENTS 60-107975 6/1985 Japan .

*Primary Examiner*—Benjamin R. Fuller
*Assistant Examiner*—Sydney O. Johnson, Jr.
*Attorney, Agent, or Firm*—Tallam I. Nguti

[57] ABSTRACT

A liquid ink printer, depositing ink to form an image having a first resolution on a recording medium moving in a first direction, including a scanning carriage moving along a carriage rail in a scanning direction substantially transverse to the first direction. The printer includes a liquid ink printhead, coupled to the scanning carriage, including ink ejectors spaced at a second resolution, different from the first resolution, and a moving device, coupled to the printhead, moving the printhead in the first direction. The printhead is moved in the second direction to deposit a first swath of ink on the recording medium. The printhead is then moved in the first direction, and again moved in the second direction to deposit a second swath of ink on the recording medium, the first swath and the second swath overlapping. The printhead is moved in the first direction by either moving the carriage rail or by moving the scanning carriage with respect to the carriage rail by a distance approximately equal to one-half the distance between adjacent ink ejectors.

9 Claims, 5 Drawing Sheets

LIQUID INK PRINTER INCLUDING A CAMMING PRINTHEAD TO ENABLE INCREASED RESOLUTION PRINTING

CROSS-REFERENCE TO RELATED APPLICATION

Cross-reference is made to patent application Attorney Docket Number D/95030 entitled "Liquid Ink Printer Including a Displaceable Printhead to Enable Interlaced Printing", herein incorporated by reference.

FIELD OF THE INVENTION

This invention relates generally to a method and apparatus for liquid ink printing and more particularly to increasing the printing resolution of a liquid ink printhead though displacement of the printhead with respect to the recording medium

BACKGROUND OF THE INVENTION

Liquid ink printers of the type frequently referred to as continuous stream or as drop-on-demand, such as piezoelectric, acoustic, phase change wax-based or thermal, have at least one printhead from having drop ejectors which droplets of ink are directed towards a recording sheet. Within the printhead, the ink is contained in a plurality of channels. Power pulses cause the droplets of ink to be expelled as required from orifices or nozzles at the end of the channels.

In a thermal ink-jet printer, the power pulses are usually produced by resistors, each located in a respective one of the channels, which are individually addressable to heat and vaporize ink in the channels. As voltage is applied across a selected resistor, a vapor bubble grows in the associated channel and initially the ink bulges from the channel orifice. The bubble quickly collapses and the ink within the channel then retracts and separates from the bulging ink thereby forming a droplet moving in a direction away from the channel orifice and towards the recording medium whereupon hitting the recording medium a dot or spot of ink is deposited. The channel is then refilled by capillary action, which, in turn, draws ink from a supply container of liquid ink. Operation of a thermal ink-jet printer is described in, for example, U.S. Pat. No. 4,849,774.

The ink jet printhead may be incorporated into either a carriage type printer, a partial width array type printer, or a page-width type printer. The carriage type printer typically has a relatively small printhead containing the ink channels and nozzles. The printhead can be sealingly attached to a disposable ink supply cartridge and the combined printhead and cartridge assembly is attached to a carriage which is reciprocated to print one swath of information (equal to the length of a column of nozzles), at a time, on a stationary recording medium, such as paper or a transparency. After the swath is printed, the paper can be stepped a distance equal to the height of the printed swath or a portion thereof, so that the next printed swath is contiguous or overlapping therewith. This procedure is repeated until the entire page is printed. One such printer is the Xerox 4004 which includes a cammed scan carriage which is manually moved by a user to move the scan carriage with respect to a print platen to provide for printing of different thicknesses of recording medium.

In contrast, the page width printer includes a stationary printhead having a length sufficient to print across the width or length of a sheet of recording medium at a time. The recording medium is continually moved past the page width printhead in a direction substantially normal to the printhead length and at a constant or varying speed during the printing process. A page width ink-jet printer is described, for instance, in U.S. Pat. No. 5,192,959.

Printers print information received from an image output device such as a personal computer. Oftentimes, this received information is in the form of a raster scan image such as a full page bitmap or in the form of an image written in a page description language. The raster scan image includes a series of the scan lines or rows consisting of bits representing pixel information in which each scan line or row contains information sufficient to print a single fine line of information across a page in a linear fashion. Printers can print bitmap information as received. If a printer receives an image written in the page description language, however, the printer or the image input device converts the page description language to a bitmap consisting of pixel information.

The density of information contained in the full page bitmap can correspond to the density of the image to be printed by the liquid ink printer. For instance, in a thermal ink jet printhead printing at 300 spots per inch, the full page bitmap will have information enabling the printhead to print at the required density. Known printers also manipulate image bitmaps to print at resolutions greater than or less than the resolution of the received image.

In reciprocating carriage printers, image defects can occur due to non-uniform absorption and drying of the ink. These image defects can be reduced by printing the image in more than one pass of the printhead, including where each pass prints a portion of the pixels in a dot pattern known as a "checkerboard" pattern. In this type of two pass printing, a first pass of the printhead carriage prints a swath of information in which odd numbered pixels of odd numbered rows or scanlines and even numbered pixels of even numbered rows or scanlines of a bitmap are printed. In a second pass of the carriage printhead, the complementary pattern consisting of even numbered pixels in odd numbered rows and odd numbered pixels in even numbered rows is printed. By printing in two passes, the ink printed in the first pass has time to dry partially before the ink from the second pattern is deposited.

Various methods and apparatus of printing with liquid ink printers are described in the following disclosures which may be relevant to certain aspects of the present invention.

In U.S. Pat. No. 4,748,453 to Lin et al. a method of depositing spots of liquid ink upon selected pixel centers is described. A line of information is printed in at least two passes so as to deposit spots of liquid ink on selected pixel centers in a checkerboard pattern wherein only diagonally adjacent pixel areas are deposited in the same pass.

U.S. Pat. No. 4,965,593 to Hickman describes a dot printer wherein the spacing of ink jet nozzles of a print head are spaced by an amount greater than the pixel spacing of the printing medium such that adjacent pixels are not printed until the deposited colorant has time to dry.

U.S. Pat. No. 4,967,203 to Doan et al. describes an interlace printing process for an ink jet printer. Printed images are produced by staggering applications of ink dots to pixel locations such that overlapping ink dots are printed on successive passes of a printhead and such that swaths are partially printed on overlapping passes of the printhead. Multi-colored or multi-shaded images are completed by grouping pixels into superpixels and applying various combinations of colored ink dots to the various pixels within each superpixel in a staggered sequence.

U.S. Pat. No. 4,999,646 to Trask describes a method for enhancing the uniformity and consistency of dot formation produced by color ink jet printing. A multiple pass complementary dot pattern ink jet printing process uses successive printed swaths made by depositing first and second partially overlapping complementary dot patterns on a print media.

Japanese Laid Open publication number 60-107975, laid open Jun. 13, 1985, describes an ink jet recording apparatus including array means where dots are arrayed in such a manner that every other column is printed with alternation of an odd row and an even row in a first scan and portions not printed by the first scan are printed by the second scan.

SUMMARY OF THE INVENTION

In accordance with one aspect of the present invention, there is provided a liquid ink printer, depositing ink to form an image having a first resolution on a recording medium advanced in a first direction, including a scanning carriage moving along a carriage rail in a scanning direction substantially transverse to the first direction. The printer includes a liquid ink printhead, coupled to the scanning carriage, including ink ejectors spaced at a second resolution, different from the first resolution, and a moving device, coupled to the printhead, moving the printhead in the first direction.

Pursuant to another aspect of the invention, there is provided a method of printing an image having a first resolution on a recording medium advanced in a first direction with a liquid ink printhead, moving in a second direction substantially transverse to the first direction, including drop ejectors spaced at a second resolution ejecting ink in a plurality of swaths. The method includes the steps of moving the printhead in the second direction to deposit a first swath of ink on the recording medium, moving the printhead in the first direction, and moving the printhead in the second direction to deposit a second swath of ink on the recording medium, the first swath and the second swath overlapping.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE INVENTION

Figure 1:
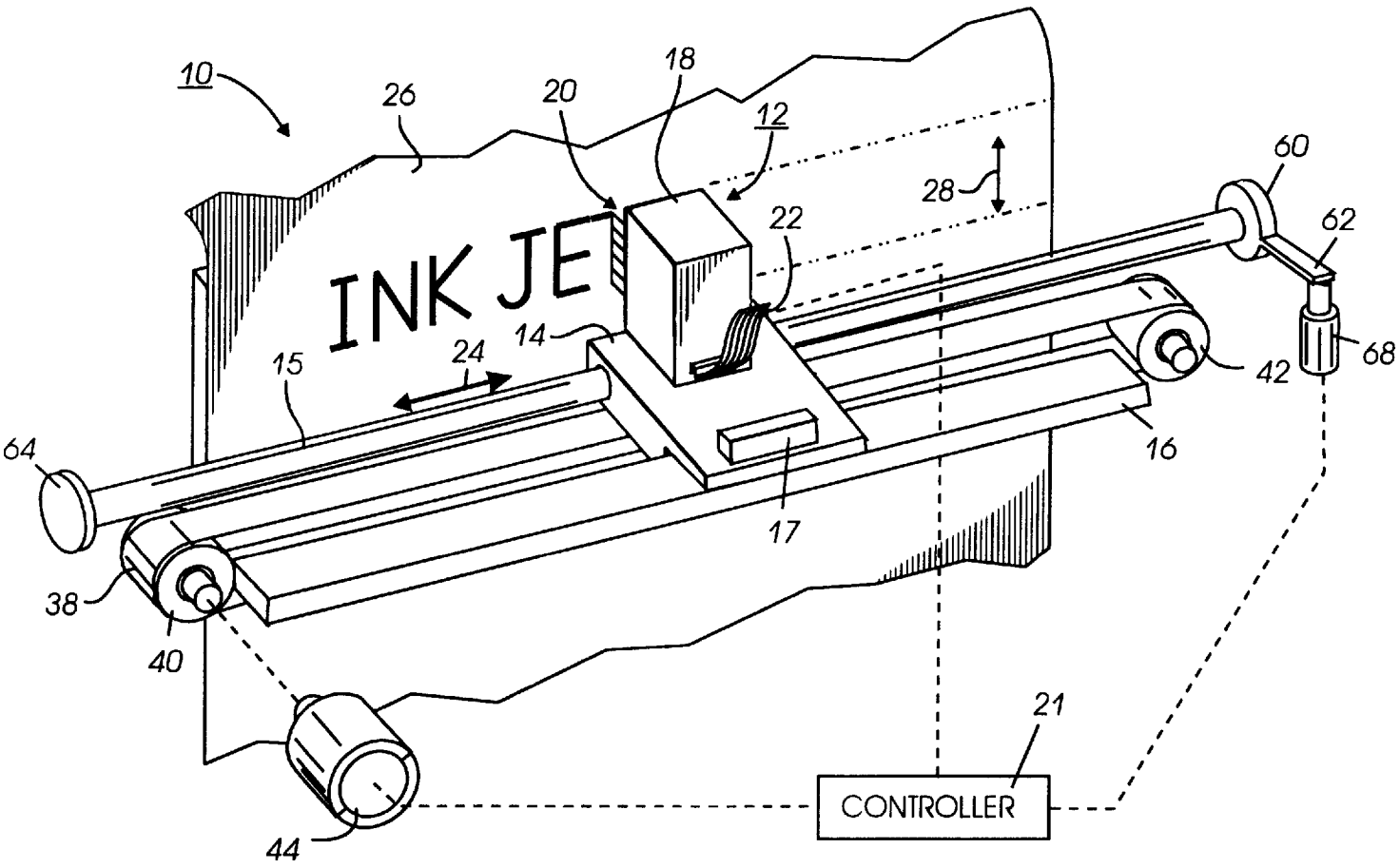
FIG. 1 is a partial schematic perspective view of an ink jet printer incorporating the present invention.

FIG. 1 illustrates a partial schematic perspective view of one type of liquid ink printer, an ink jet printer 10, having an ink jet printhead cartridge 12 mounted on a carriage 14 supported by a carriage rail 15 and a slide rail 16. A weight 17 is attached to the carriage 14 and maintains contact of the carriage 14 with the slide rail 16 during movement of the carriage. The printhead cartridge 12 includes a housing 18 containing ink for supply to a thermal ink jet printhead 20 which selectively expels droplets of ink under control of electrical signals received from a controller 21 of the printer 10 through an electrical cable 22. The printhead 20 contains a plurality of ink conduits or channels (not shown) which carry ink from the housing 18 to respective ink ejectors, which eject ink through orifices or nozzles (also not shown). When printing, the carriage 14 reciprocates or scans back and forth along the carriage rail 15 and slide rail 16 in the directions of an arrow 24 at a constant speed. As the printhead cartridge 12 reciprocates back and forth across a recording medium 26, such as a sheet of paper or transparency, droplets of ink are expelled from selected ones of the printhead nozzles towards the sheet of paper 26. The ink ejecting orifices or nozzles are typically arranged in a linear array substantially perpendicular to the scanning direction 24. During each pass of the carriage 14, the recording medium 26 is held in a stationary position. For a more detailed explanation of the printhead and printing thereby, refer to U.S. Pat. No. 4,571,599 and U.S. Pat. No. Reissue 32,572, the relevant portions of which are incorporated herein by reference.

It is well known and commonplace to program and execute imaging, printing, document, and/or paper handling control functions and logic with software instructions for conventional or general purpose microprocessors, such as the controller 21. This is taught by various prior patents and commercial products. Such programming or software may of course vary depending on the particular functions, software type, and microprocessor or other computer system utilized, but will be available to, or readily programmable without undue experimentation from, functional descriptions, such as those provided herein, or prior knowledge of functions which are conventional, together with general knowledge in the software and computer arts. That can include object oriented software development environments, such as C++. Alternatively, the disclosed system or method may be implemented partially or fully in hardware, using standard logic circuits or a single chip using VLSI designs.

The carriage 14 is moved back and forth in the scanning directions 24 by a belt 38 attached thereto. The belt 38 is driven by a first rotatable pulley 40 and a second rotatable pulley 42. The first rotatable pulley 40 is, in turn, driven by a reversible motor 44 under control of the controller 21 of the ink jet printer. In addition to the toothed belt/pulley system for causing the carriage to move, it is also possible to control the motion of the carriage by using a cable/capstan, lead screw or other mechanisms as known by those skilled in the art.

To control the movement and/or position of the carriage 14 along the carriage rails 16, the printer includes an encoder having an encoder strip which includes a series of fiducial marks in a pattern (not shown). The pattern is sensed by a sensor, such as a photodiode/light source attached to the printhead carriage. The sensor includes a cable which transmits electrical signals representing the sensed fiducial marks of the pattern to the printer controller. Other known encoders, such as rotary encoders are also possible.

In a typical thermal ink jet desktop printer, such as the Xerox 4004, the printed image is created by moving the recording medium 26 past the printhead 12. The scan carriage of such a printer is situated such that the ink jet printhead scans across the page in a direction substantially perpendicular to the paper motion. In operation, the recording medium is stationary as the printhead scans across the width thereof, thus printing a complete swath of the image. The paper is then advanced a distance corresponding to one swath height or less and the process is repeated. A single shaft with tightly controlled straightness is used as a carriage scan rail which is fixed with respect to the printer as well as the printer housing or printer support structure. Secondary support is provided, for instance, by a slide rail 16 such as shown in FIG. 1 which serves as a anti-rotation shelf. The printhead is fully constrained to travel in a straight line dictated by the scan rail. Consequently, the printhead 12 cannot move in either of the directions 28. The printing resolution of is thereby constrained to the resolution of the printhead which is equivalent to the spacing of the drop ejectors which in the case of the Xerox 4004 is 300 dots per inch. While increased resolution has been shown in the art by increasing the resolution of the printhead by making the drop ejectors smaller and spacing them closer together or by advancing the paper one half the distance of the distance between adjacent drop ejectors of the printers, both of these solutions are not easily implemented nor are they inexpensive. For instance, in the case of increasing the printhead resolution of the printhead, significant redesign of the printhead is necessary. Likewise, for the case where printing resolution is increased by moving the paper in small increments, the necessary fineness of paper advance mechanisms is not easily obtained.

Figures 4, 4A:
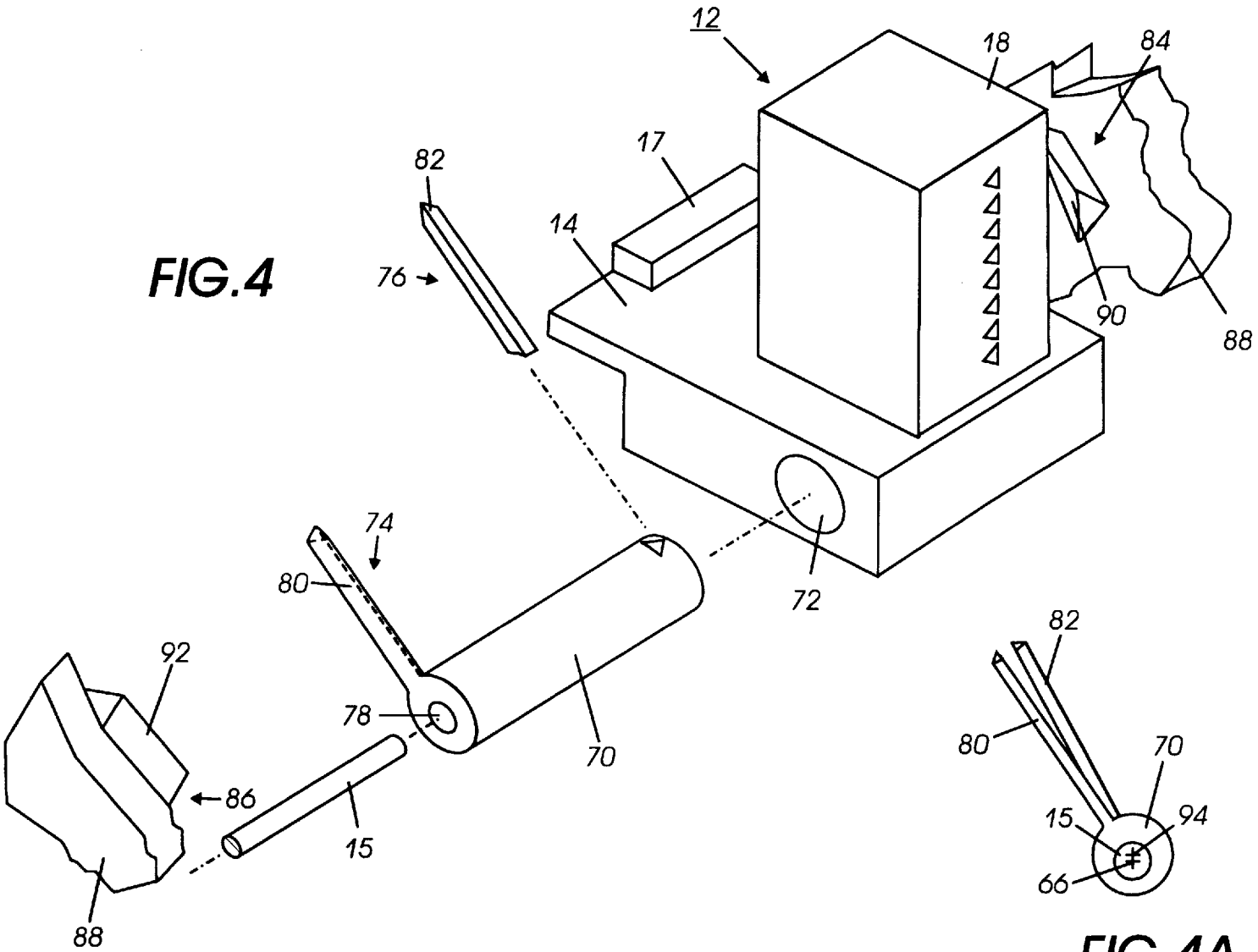
FIG. 4 is an exploded partial schematic perspective view of another embodiment of the present invention.
FIG. 4A is a partial schematic side view of FIG. 4 illustrating a camming bushing including a bushing arm.
Figure 5:
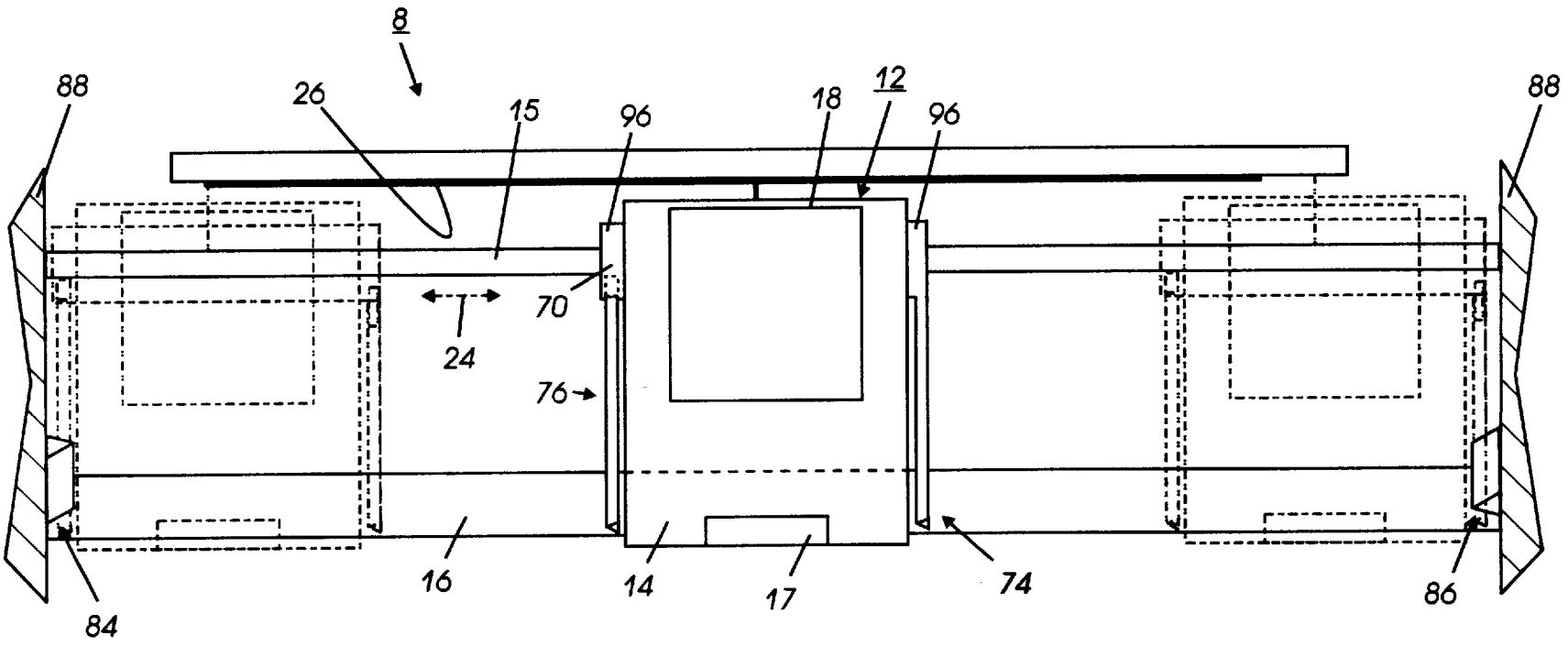
FIG. 5 is a schematic plan view of the embodiment of FIG. 4.

The present invention, however, achieves higher printing resolutions by moving the printhead 12 in the direction 28 while the recording medium is held stationary at a single location. This is accomplished by the present invention by either moving the carriage scan rail 15 in the direction 28, a distance equal to one-half the distance between adjacent drop ejectors of the printhead 12 as illustrated in FIGS. 1 and 3 or by moving the carriage 14 with respect to the carriage rail 15 as illustrated in FIGS. 4, 4A and 5.

Figure 2:
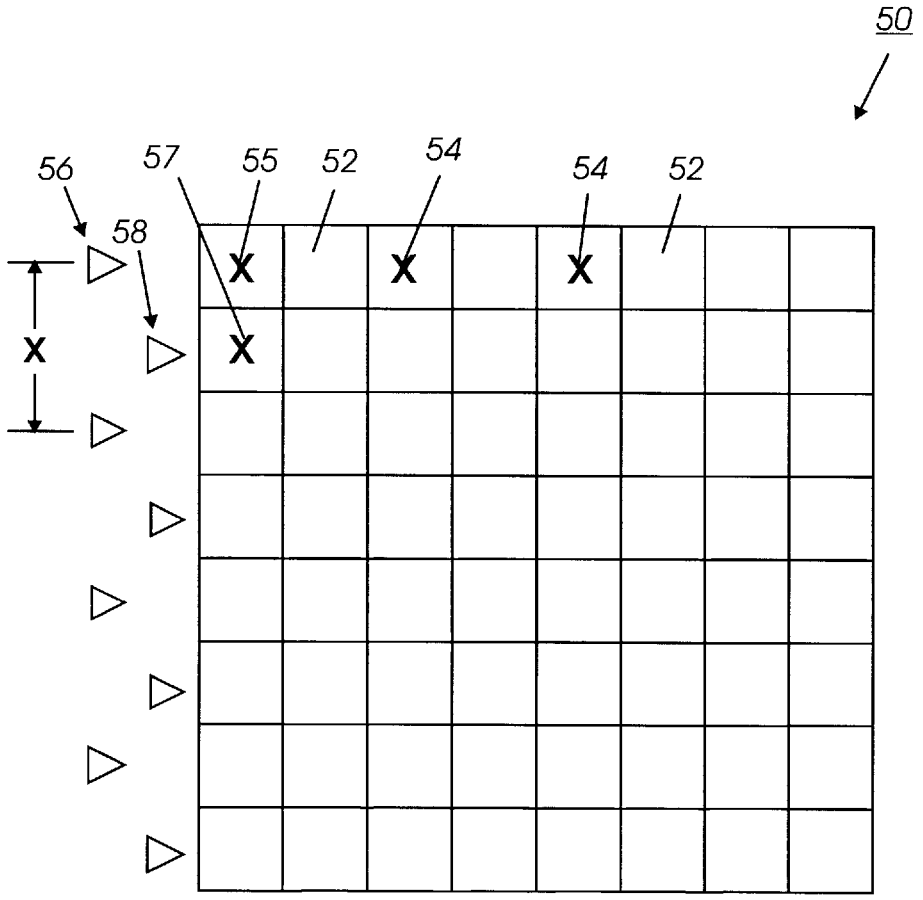
FIG. 2 illustrates pixel grid indicating ink drop locations deposited along scan lines having a first resolution and drop ejectors of a liquid ink printhead spaced at a second resolution different than the first resolution.

FIG. 2 illustrates a pixel grid 50 defining a plurality of pixel locations 52 having drop centers 54 indicating where the location of individual ink drops are to be deposited during scanning of the printhead. The drop centers 55 and 57 are vertically spaced a distance which is equivalent to the vertical resolution of the printed image. The present invention accomplishes this resolution by making a first scan and a second scan with the printhead by displacing the printhead with respect to the recording medium as shown by a first plurality of drop ejectors 56 indicating the location of the printhead 12 during a first scan of the printhead and a second plurality of drop ejectors 58 of the same printhead illustrating the location of the printhead with respect to the recording medium during a second swath of the printhead. As illustrated, the drop ejectors of the printhead are separated a distance X apart, which is approximately equal to twice the distance between adjacent drop centers in the vertical direction such as drop centers 55 and 57.

Figure 3:
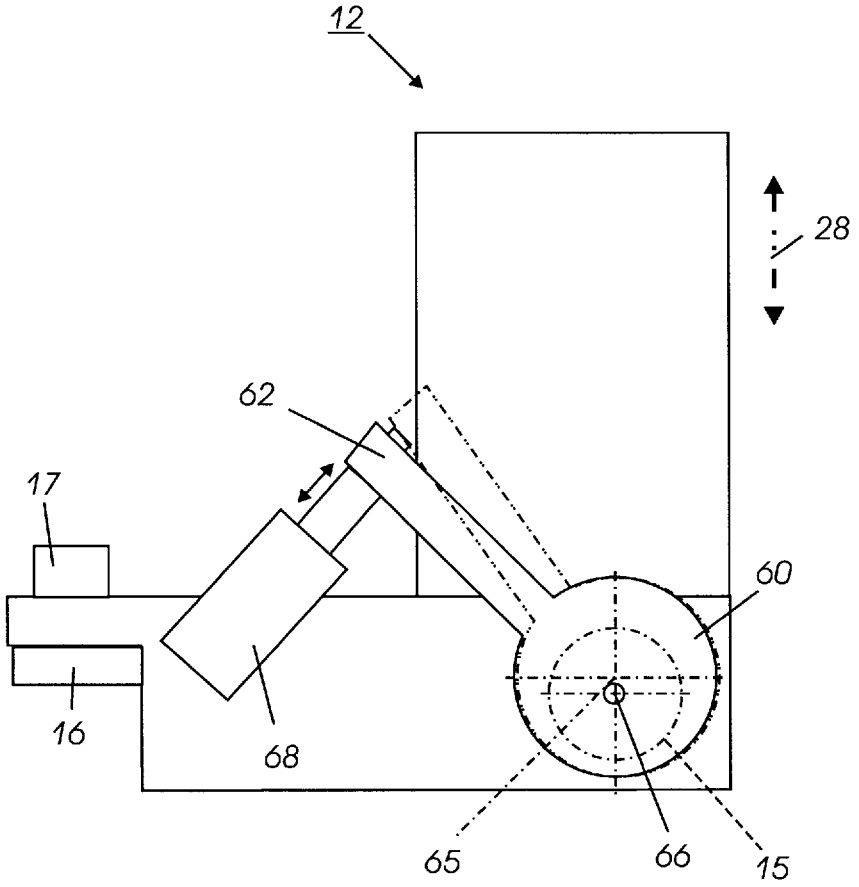
FIG. 3 is a schematic side view of FIG. 1 illustrating the moving mechanism of one embodiment of the present invention.

As illustrated in FIG. 1 and FIG. 3, in a first embodiment of the invention, the present invention includes the carriage rail 15 which is movable by an eccentric scan rail bushing 60 having a bushing arm 62 attached thereto. A second eccentric scan rail bushing 64 is disposed at the opposite end of the carriage rail 15. The scan rail bushing 60 is attached to the carriage rail 15 such that movement of the scan rail bushing 60 moves the carriage rail 15 in the direction 28 such that the carriage rail 15, the scanning carriage 14 and the printhead 12 are also moved in the direction 28. As illustrated, the scan rail bushing 60 includes a center 65 which is offset from a center 66 of the scan carriage 15. This view of centers 65 and 66 is merely illustrative to show differences between the centers thereof. Both of the eccentric bushings 60 and 64 are rotatably held in a frame or other supporting structure of the printer (not shown). It is possible, although not essential, to key each bushing to the carriage rail by using a flat, a pin or other similar feature.

To effect higher resolution printing, such as increasing the resolution of a 300 dot per inch printhead to print an image at 600 dot per inch, the bushing rail 15 is cause to rotate through a fixed angle by rotation of the eccentric bushing 60 through movement of the carriage arm 62 provided by, for instance, an electromover such as a solenoid 68. The solenoid 68 is coupled to the controller 21 for control thereof to effect movement of the printhead in the direction 28 a distance equal to approximately one-half the spacing between adjacent drop ejectors. By selecting the amount of eccentricity, orientation of the eccentricity relative to the paper motion axis, and the angle of rotation, desired displacement of the printhead can be achieved, while minimizing movement of the printhead either toward or away from the surface of the recording medium surface. It would be also possible to move the printhead at distances less than one-half the distance between adjacent printhead nozzles and to decrease the size of the drop ejectors such that even higher increases in resolution can be achieved. It has been found that to achieve a 600 drop per inch printing resolution, ink channels having smaller ink ejecting orifices and generating ink jet drops that have approximately one-fourth the volume of a standard 300 drop per inch printhead are sufficient. Alternatively, it is also found that use of a specially coated recording medium together with standard 300 drop per inch orifices can yield spot sizes that are substantially similar to those provided by 600 drop per inch orifices.

Another embodiment of the present invention, is illustrated in FIG. 4, FIG. 4A, and FIG. 5. In this embodiment, an eccentric bushing 70 is inserted through an aperture or bore 72 of the scan carriage 14. The eccentric bushing 70 includes a first bushing arm 74 and a second bushing arm 76. The scan rail 15 is inserted through an aperture 78 of the eccentric bushing. In this embodiment, the eccentric bushing is used to locate the carriage 14 with respect to the scan rail 15 which remains stationary by being fixed to a supporting structure of the printer. The bushing rotates between two angular stops within the carriage bushing bore 72. The amount of eccentricity and the angle traveled are selected to move the printhead approximately one-half the spacing between adjacent drop ejectors along the paper motion axis without affecting the relative gap between the printhead and the paper which must be accurately controlled for ink jet printing.

The rotation of the bushing 70 is accomplished by using the motion of the scan carriage. The bushing arm 74 and the bushing arm 76 which are fastened to each end of the eccentric bushing 70 include, for instance, a wedge shape having inclined surfaces 80 and 82. At each end of the scan rail 15 is placed a first camming member 84 and a second camming member 86, each of which is positively attached to a supporting structure 88 of the printer. The camming members 84 and 86 are here illustrated, for instance, as a wedge member, each of which includes an incline surface 90 and 92, respectively. As the carriage 14 reaches one end of its travel, the related camming member interferes with the bushing arms of the eccentric bushing 70 and forces it to rotate through an angle determined by the cam member geometry as well as its placement on the supporting structure 88. As the carriage reaches the opposite end of its travel, the second camming member applies an equal and opposite rotation to the eccentric bushing via the other bushing arm. As illustrated in FIG. 4A, the eccentric bushing 70 includes a center of rotation 94 which is offset from the center of the carriage rail 15.

As further illustrated in the plan view of FIG. 5, the relative geometries and placements of the camming members 84 and 86 with respect to the anticipated travel of the carriage 14 illustrates the interaction of the bushing arm 76 and the bushing arm 74 with camming member 84 and camming member 86. As can be seen, towards the end of carriage travel at either end, a bushing arm contacts a camming member. Upon further movement of the carriage, this interaction forces rotation of the bushing 70 about the carriage 15. Due to the eccentric relationship between the bushing and carriage rail, the printhead is moved in a direction substantially perpendicular to the moving direction of the scan carriage across the page. Once the scan carriage reaches the end of its travel, the inclined surface of the camming member has forced the bushing 70 to fully rotate into position for the next pass of the printhead offset from the previous pass by a distance equivalent to one pixel location. Since this embodiment contemplates printing in both the forward and reverse passes of the printhead, the member 84 and member 86 define an axis therebetween which is not parallel to the carriage rail. This may be embodied, for instance, by spacing each of the members a different distance from a plane defined by the carriage rail 15.

The eccentric bushing 70 rotates freely within the carriage aperture 72 but is constrained from moving in the scan direction by, for instance, shoulders 96. In addition, the fit of the eccentric bushing 70 within the carriage 14 should have sufficient frictional resistance such that the eccentric bushing rotation occurs only when contact is made with a camming member.

The present invention includes a variety of advantages such as providing a very precise and repeatable motion by using low cost parts and taking advantage of the camming operation and also decoupling the interlace function from the paper advance mechanism. The paper drive can thereby be optimized for a single advance distance, which in one embodiment of the present invention would be a distance equivalent to one swath minus a single pixel location.

In recapitulation, there has been described an apparatus and method for increasing the printing resolution of a liquid ink printhead having a fixed spacing between drop ejectors. It is, therefore, apparent that there has been provided in accordance with the present invention, a liquid ink printer including a camming printhead to enable increased resolution printing. While this invention has been described in conjunction with a specific embodiment thereof, it is evident that many alternatives, modifications, and variations will be apparent to those skilled in the art. For instance, while the embodiment using carriage motion to effect movement of the printhead illustrates mechanical camming, the same embodiment can effect movement through electromechanical movement such as the use of solenoids, located at either end of the carriage travel, but which move the arms though at either end of travel. In addition, the present invention is not limited to thermal ink jet printers, for instance, but is equally applicable to all types of liquid ink printers as well as to dot matrix printers. Accordingly, it is intended to embrace all such alternatives, modifications, and variations that fall within the spirit and scope of the appended claims.

What is claimed is:

1. A liquid ink printer depositing ink to form an image having a first resolution on a recording medium advanced in a first direction, including a scanning carriage moving along a carriage rail in a scanning direction substantially transverse to the first direction, comprising:

a liquid ink printhead, coupled to said scanning carriage, including ink ejectors spaced at a second resolution, different from the first resolution; and a moving device comprising an electromover moving the carriage rail, and an eccentric bushing coupled to the carriage rail and to the electromover, said eccentric bushing being moved by said electromover to move the carriage rail, said moving device being coupled, to said printhead, through the scanning carriage and through the carriage rail, for moving said printhead in the first direction.

2. The liquid ink printer of claim 1, wherein said eccentric bushing includes a bushing arm, said bushing arm coupled to said electromover.

3. The liquid ink printer of claim 2, wherein said electromover moves the printhead through movement of the carriage rail a distance approximately equal to one-half the first resolution.

4. The liquid ink printer of claim 3, wherein the first resolution is approximately equal to 600 dots per inch.

5. The liquid ink printer of claim 1, wherein said eccentric bushing is disposed between said carriage rail and said scanning carriage, said eccentric bushing including a bushing arm, and being movable with respect to said carriage rail to move said printhead with respect to said carriage rail.

6. The liquid ink printer of claim 5, comprising a camming member fixedly coupled to said printer, said camming member contacting said bushing arm during movement of said scanning carriage.

7. The liquid ink printer of claim 6, wherein said camming member includes a wedge member, disposed at one end of said carriage rail and having an inclined surface contacting said bushing arm during movement of said scanning carriage, moving said bushing arm and said liquid ink printhead to a first position with respect to said recording medium.

8. The liquid ink printer of claim 7, wherein said camming member comprises a second wedge member disposed at another end of said carriage rail and having an inclined surface contacting said bushing arm during movement of said scanning carriage, moving said bushing arm and said liquid ink printhead to a second position with respect to the recording medium, different than said first position.

9. The liquid ink printhead of claim 8, wherein said first position and said second position are spaced a distance equal to approximately one-half the second resolution.

* * * * *